United States Patent [19]

Angus

[11] Patent Number: 4,632,427

[45] Date of Patent: Dec. 30, 1986

[54] COMBINED MAILER AND RETURN ENVELOPE

[75] Inventor: Gordon Angus, Toronto, Canada

[73] Assignee: Moore Business Forms, Inc., Grand Island, N.Y.

[21] Appl. No.: 482,573

[22] Filed: Apr. 6, 1983

[51] Int. Cl.[4] ..... B41L 1/20; B41L 5/04; B65D 27/10; B65D 27/06

[52] U.S. Cl. ..... 282/11.5 R; 282/15 A; 229/69; 229/73

[58] Field of Search ..... 282/15 A, 25, 11.5 R; 229/69, 70, 71, 72, 73

[56] References Cited

U.S. PATENT DOCUMENTS

| | | | |
|---|---|---|---|
| 2,895,664 | 7/1959 | Cone . | |
| 3,411,699 | 11/1968 | Pine et al. . | |
| 3,497,132 | 2/1970 | Henry . | |
| 3,952,942 | 4/1976 | O'Leary et al. . | |
| 3,977,597 | 8/1976 | Wise et al. | 229/73 |
| 3,981,435 | 9/1976 | Johnson | 229/73 |
| 4,023,727 | 5/1977 | Tess | 229/73 |
| 4,055,294 | 10/1977 | Traise . | |
| 4,148,430 | 4/1979 | Drake . | |
| 4,211,435 | 7/1980 | Reese | 282/25 |

FOREIGN PATENT DOCUMENTS

| | | | |
|---|---|---|---|
| 88613 | 9/1983 | European Pat. Off. | 229/69 |
| 238384 | 10/1978 | Fed. Rep. of Germany | 229/69 |

*Primary Examiner*—Paul A. Bell
*Assistant Examiner*—Paul M. Heyrana, Sr.
*Attorney, Agent, or Firm*—Allegretti, Newitt, Witcoff & McAndrews, Ltd.

[57] ABSTRACT

A two-way envelope has a front and rear surface formed of a single rectangular sheet folded upon itself about a transverse central foldline. The envelope comprises overlying front and rear return envelope panels, overlying front and rear data bearing panels, and front and rear transverse lines of separation parallel to the central transverse foldline and separating the return envelope panels from the data bearing panels. The transverse lines of separation are offset to define on one surface of the envelope a return envelope flap adjoining one of the return envelope panels by a line of weakness. Adhesive is disposed on the inner surface of the return envelope flap, and sealing means secures the three free edges of the two-way envelope about the central foldline except those portions of the edge coincident with the return envelope flap.

15 Claims, 5 Drawing Figures

COMBINED MAILER AND RETURN ENVELOPE

BACKGROUND OF THE INVENTION

Field of the Invention and Description of the Prior Art

This invention relates generally to a combined mailer and return envelope unit, or two-way envelope, which is adapted to be utilized in continuous form formatting and in high speed processing.

By continuous form formatting is meant that the individual mailer and return envelope units are detachably secured together to form a strip of such units which may be stored in the form of rolls or other conventional means. In order to utilize the continuous strips of units in high speed processing equipment, the margins of the strip, which may be detachable, are provided with a row of aligned apertures (commonly referred to as line-holes) which allow the strip to be drawn through a printer or other processing equipment, preferably at high speed.

Mailer and return envelope units, or two-way envelopes of this type are frequently employed in business for the purpose of collecting acounts, obtaining information, soliciting funds, seeking orders etc. The object of a mailer and return envelope unit of the type contemplated is to create, in as simple a manner as possible, a folded mailer which forms a sealed envelope to be used for the transmission of data or the like to a primary addressee, and which, when opened by the primary addressee, provides both a ready to use return envelope component for return to a secondary addressee (usually the original sender), as well as data bearing surfaces which may be retained, if desired, by the primary addressee and/or returned in conjunction with a check, additional data or the like, to the secondary addressee.

In order to induce prompt payment of accounts, or prompt return of solicited information, or the like, it has in the past been the practice for senders to include with statements of account, solicitations or the like, return envelopes for the use of the primary addressee, because experience has shown that the primary addressee frequently does not have suitable envelopes handy for this purpose and will frequently delay or forget return correspondence unless such is provided. Further, even if the primary addressee does have a suitable envelope available, frequently, upon its return to the secondary addressee, the secondary address will be incomplete or erroneous, leading to unnecessary delay, and sometimes complete misdirection in which case the return envelope may never be received by the secondary addressee. These problems are overcome by providing a return envelope which is properly addressed to the secondary addressee. However, the use of a separate envelope in conjunction with a primary mailer tends to be rather expensive, both because a separate and complete envelope unit must be printed and provided, and also because the primary envelope has to be stuffed by hand, or at least with the aid of rather complex and expensive mechanical equipment.

Many attempts have been made to overcome both the need to employ a discrete return envelope with a primary mailer, and also the need to use manual stuffing operations, or at least the complex and expensive mechanical equipment that would be required to stuff a primary mailer with materials including a return envelope. Accordingly, various forms of combined mailer and return envelope units have evolved which have overcome some of the disadvantages of using completely separate primary and return envelopes, but which nevertheless themselves give rise to certain disadvantages. For example, one such mailer and return envelope unit is disclosed in O'Leary et al U.S. Pat. No. 3,952,942 dated Apr. 27, 1976. This patent relates to a continuous form mailer with integral detachable insert material and return envelope comprised of two overlying sheets of material secured together along peripheral side edges and including an integral return envelope portion and a detachably removable invoice-receipt portion and an insertable return stub material portion. The complete assembly serves as a primary envelope which is capable of being snapped apart by the primary addressee to open the primary envelope and to separate the return envelope portion from the invoice-receipt and return stub portions. One of the disadvantages of this form, apart from the fact that it must be formed of two separate sheets which must be appropriately aligned in overlying relationship and secured together to form the primary envelope, is that the upper sheet must be provided with an internal layer of transfer material so that data might be appropriately printed through the external ply onto one of the internal surfaces when the assembly is run through a printer for the application of data to be communicated to the primary addressee. Such transfer material is relatively expensive in itself, and its application to the internal surface of the upper ply of the two ply assembly involves a separate processing step which substantially increases the cost of the overall assembly.

The Cone U.S. Pat. No. 2,895,664 dated July 21, 1959 shows a mailer and return envelope assembly which does not require the use of transfer material on an internal surface of the primary assembly for the transfer of data to another internal surface, but contemplates that the data will be printed on one surface which will be covered by a folded over portion which is then appropriately adhesively secured to form the primary envelope. However, the folded over portion, when the primary envelope is opened, is utilized as the return envelope, and, for this purpose, the folded over portion comprises two layers of material which must be appropriately aligned and secured together before the primary envelope is formed. Again, this involves a separate processing step which tends to increase the cost of the assembly and also increase its complexity.

The Drake U.S. Pat. No. 4,148,430 dated Apr. 10, 1979 discloses a modified form of mailer and return envelope assembly which is somewhat similar to that disclosed in U.S. Pat. No. 2,895,664, in that it contemplates folding a single sheet upon itself to form the primary envelope, although one portion of the sheet so folded over is itself provided with an overlying layer of material which forms an internally disposed return envelope portion when the main sheet is folded upon itself to produce the primary envelope. Accordingly, this construction is subject to the same disadvantages as those inherent to the construction of U.S. Pat. No. 2,895,664.

The Henry et al U.S. Pat. No. 3,497,132 discloses a mailer and return envelope assembly which is formed of a single sheet of material appropriately shaped, folded, and folded upon itself so as to provide a primary envelope and, when opened in the correct manner by the primary addressee, may also be used to form a return envelope. However, this envelope is intended to be utilized with separate contents (as opposed to the envelope assembly itself bearing the data to be communicated to the primary addressee) and the assembly blank is of complex shape with the production of the envelope involving rather complex folding and sealing operations. An envelope of this type is not suited to utilization with high speed processing equipment, and, indeed, the assembly disclosed in the patent is not adapted for use with a high speed printer in its combined mailer and return envelope format.

SUMMARY OF THE INVENTION

The object of the present invention is to overcome the disadvantages of known prior art assemblies by providing a primary and return envelope unit, or two-way envelope, which is produced from a single sheet of material and which may be adapted to continuous form formatting, to which data to be communicated to a primary addressee may be applied in a high speed printer, and which may then be folded upon itself and sealed to form a primary and return envelope assembly. The assembly appropriately carries all relevant data to be communicated to the primary addressee as well as preprinted and appropriately located primary and return addresses, and the assembly may be opened by tearing, or by a snap apart action to leave a discrete and readily usable return envelope as well as a data bearing sheet or sheets, part of which may be retained by the primary addressee, and part of which may be returned to the secondary addressee in the return envelope.

Accordingly, in a broad aspect, the invention resides in a two-way envelope unit suitable for use in continuous form formatting, comprising a single rectangular sheet having a transverse central line of weakness, separable line-hole bearing side margins, parallel to said central line of weakness, and a top and bottom margin, a data receiving panel and a return envelope panel disposed between the said central line of weakness and each of said side margins, each data receiving panel being adjoined to each return envelope panel along a line of separation parallel to said central line of weakness, sealing means disposed along the top margin of at least one of said data receiving panels and at least one of said return envelope panels, and along the bottom margin of at least one of said data receiving panels and at least one of said return envelope panels, and along a side edge of at least one of the panels adjacent one of said side margins whereby, when folded about said central line of weakness, said data receiving panels overlie one another and said return envelope panels overlie one another, and said lines of separation are offset to define an adhesive bearing return envelope flap, said top and bottom margins being free of sealing means at said return envelope flap.

In another aspect, the invention resides in a two-way envelope having a front and rear surface formed of a single rectangular sheet folded upon itself about a central transverse fold line, comprising overlying front and rear return envelope panels, overlying front and rear data bearing panels, front and rear transverse lines of separation parallel to said central transverse fold line and separating said return envelope panels from said data bearing panels, said transverse lines of separation being offset to define on one surface a return envelope flap adjoining one of said return envelope panels by a line of weakness, adhesive disposed on the inner surface of said return envelope flap, and sealing means securing the three free edges of said two-way envelope about said central fold line except those portions of the edges coincident with said return envelope flap.

BRIEF DESCRIPTION OF THE DRAWINGS

In the drawings which illustrate the invention.

DETAILED DESCRIPTION OF THE PREFERRED EMBODIMENT

Figure 1:
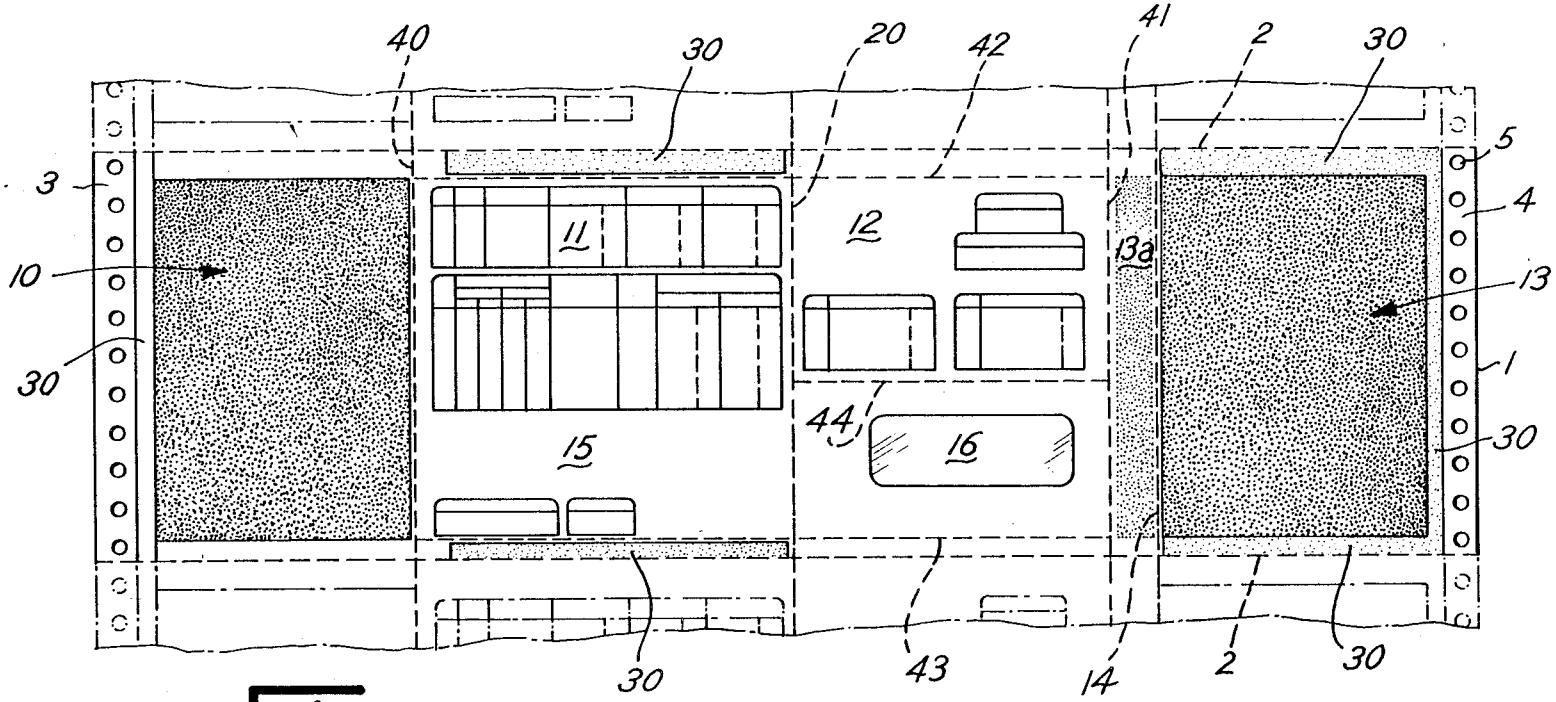
FIG. 1 is a plan view of a two-way envelope unit forming part of a continuous strip and prior to folding.

Referring now to FIG. 1 of the drawings, a mailer and return envelope unit blank 1 is shown as part of a continuous strip, separable from the remainder of the strip along perforated lines of separation 2.

Figure 2:
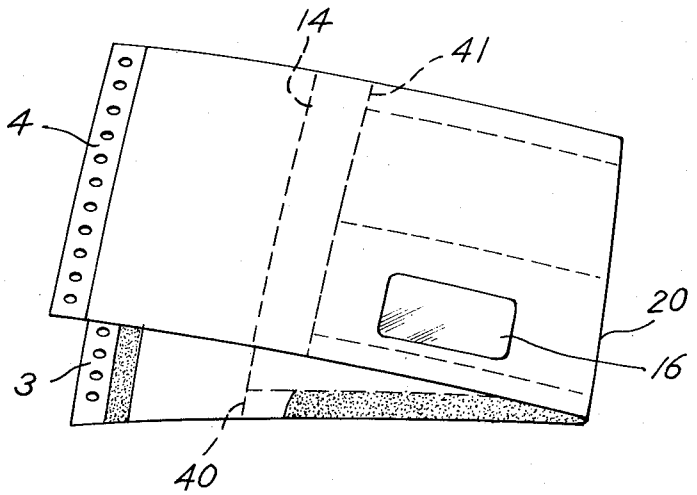
FIG. 2 is a pictorial view of a two-way envelope unit of FIG. 1, separated from the continuous strip and folded about a transverse center line.

Each unit comprises separable line-hole margins 3 and 4 bearing a plurality of aligned apertures or line-holes 5 which permit the unit, and the continuous strip of which it is a part, to be drawn through processing equipment such as a printer. The unit also comprises a return envelope rear panel 10, data receiving panels 11 and 12 and a return envelope front panel 13 which has connected thereto, along a perforated line of weakness or fold line 14, an adhesive bearing return envelope closure flap 13*a*. It will be appreciated that the closure flap may carry a gum type of adhesive which must be moistened to activate it, or a pressure sensitive adhesive covered by release paper in the conventional manner to prevent the adhesive from adhering to other parts of the mailer before the return envelope portion is detached and ready for use. The data receiving panels 11 and 12 and the return envelope panels 10 and 13 are disposed substantially symmetrically about a central transverse perforated line of weakness or fold line 20, and the data bearing panel 12 includes a rectangular window 16, which may be open, but which is preferably covered with transparent material, whereby, when the right hand half of the unit as seen in FIG. 1 is folded about the transverse central fold line 20, as illustrated in FIG. 2, a primary address printed on panel 11 at 15 will be visible through window 16.

Sealing means, such as heat activated adhesive 30 is disposed along the upper, lower and outer side margins of return envelope panel 13, and may also be disposed along the outer side margin of return envelope panel 10 to faciliate production of a more secure seal. Similarly, heat activated adhesive 30 is disposed along the upper and lower margins of data receiving panel 11 ensuring that that portion of the upper and lower margin which will be covered by return envelope flap 13*a*, when the blank is folded upon itself about center line 20, is free of the heat activated adhesive, so that the return envelope flap will not adhere to the upper and lower margins of the data receiving panel 11. It will of course be appreciated that a heat activated adhesive could be applied to the upper and lower margins of return envelope rear panel 10 either instead of or in addition to the upper and lower margins of return envelope front panel 13, and that the heat activated adhesive could be applied to the upper and lower margins of data receiving panel 12 instead of, or in addition to, the upper and lower margins of data receiving panel 11. Indeed, if the heat activated adhesive is applied to data receiving panel 12 the need to ensure that the adhesive does not overlap return envelope 13*a* would be eliminated since the outer margin of the data receiving panel 12 terminates at the return envelope flap 13*a*.

The return envelope rear panel 10 is separated from data receiving panel 11 by a perforated line of separation or tear line 40 and the data receiving panel 12 is separated from the return envelope closure flap 13*a* by a perforated line of separation or tear line 41. Additionally, perforated lines of separation or tear lines 42 and 43 are spaced inwardly from the upper and lower margins respectively of data receiving panels 11 and 12 a distance slightly greater than the width of the heat activated adhesive band 30 and data receiving panel 12 is separated into upper and lower sections by a perforated line of separation or tear line 44.

It will be appreciated that the perforations defining the tear lines and fold lines are produced in a conventional and known manner which forms no part of this invention, and it will also be apparent that the adhesive is also applied in a conventional and known manner which forms no part of the invention, whether the adhesive be of the heat activated type, the gum type which is activated by moisture, or the pressure sensitive type which is protected by a strip of release paper. It will also be apparent that the mailer unit blanks may be preprinted in a conventional manner depending upon the purpose for which they are to be used, and that the window 16 may be cut and covered with transparent material in a conventional manner. All of the foregoing is facilitated by producing the units in continuous strip form to permit continuous high speed processing.

In utilization of the mailer unit, a strip of such units such as that depicted in FIG. 1, which have been appropriately printed to receive an arrangement of data and which have a return address (usually that of the sender) printed on the reverse side of return envelope panel 13 (as best illustrated in FIG. 2), are passed through a printer to have relevant data applied thereto, as well as the name and address of the primary addressee applied to data receiving panel 11 at 15. The strip of material is then passed through a folding and sealing mechanism, so that the right hand side of the strip is folded about transverse center line 20 to overlie the left hand side of the strip as shown in FIG. 2, and, under the application of heat and pressure, the upper and lower margins of each unit are sealed (except for the portion of the margin overlapping return envelope closure flap 13*a*), and the free edge of each unit is sealed along the margin inboard of the line-hole margins 5. This produces a sealed envelope such as is shown schematically in FIG. 3*a*, the components of which are so arranged that data receiving panels 11 and 12 overlie one another with the name and address of the primary addressee appearing at 15 on panel 11 being aligned with the window 16 of panel 12 so that the identity and address of the primary addressee clearly shows on the face of the envelope. The return envelope panels 10 and 13, which are now sealed along the upper, lower, and free side margins also overlie one another, with the perforated tear lines 40 and 41 being displaced the width of the return envelope closure flap 13*a* as illustrated in FIG. 2 as well as FIGS. 3*b* and 4. The strip of sealed envelopes may then be passed through suitable severance apparatus for removal of the line hole margins 4 and for separation along lines 2 to form separate sealed mailer and return envelope units as illustrated generally in FIG. 3*a*. The sealed unit is now ready to be stamped and dispatched in the mails to the primary addressee.

Figure 3B:
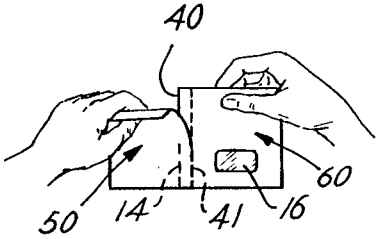
FIG. 3B (first sheet of drawings) is a pictorial view of a sealed two-way envelope in the process of opening.
Figure 3A:
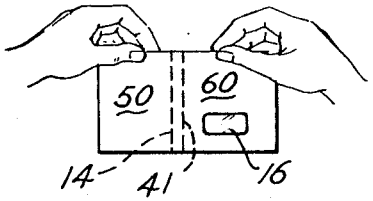
FIG. 3A (first sheet of drawings) is a schematic view of the sealed two-way envelope about to be opened.
Figure 4:
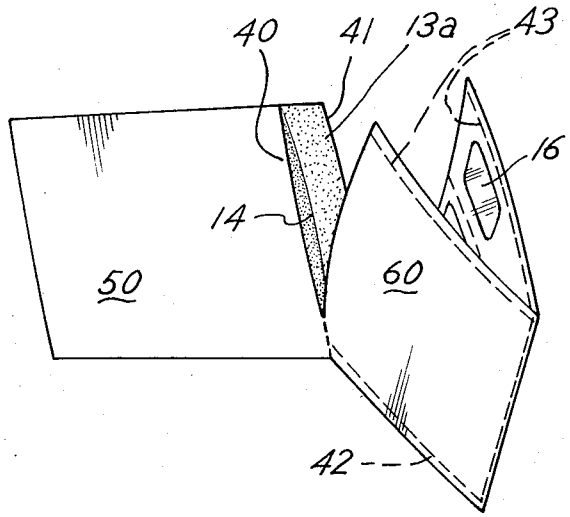
FIG. 4 is a pictorial view of an almost wholly opened two-way envelope showing the return envelope portion and, for purposes of illustration, a partially separated data receiving portion.

Upon receipt by the primary addressee, the mailer, in accordance with instructions printed thereon, is grasped in the manner illustrated in FIG. 3*a* and separated along tear lines 40 and 41 as illustrated in FIG. 3*b* to produce a return envelope segment 50 as best illustrated in FIG. 4 and a data bearing segment 60 also as illustrated best in FIG. 4, although the data bearing section 60 as shown in FIG. 4 is in a partially opened conditioned for purposes of illustration, whereas, in actual use upon opening, the upper margin would be sealed until the data bearing section is completely separated from the return envelope section and the sealed upper and lower margins are torn off along perforated tear lines 42 and 43. As is most clearly shown in FIG. 4, the return envelope section 50, by reason of the staggered or offset relationship between tear lines 40 and 41, and the sealing along the upper and lower margins and the free margin, is formed as a pocket with an integral adhesive bearing closure flap 13*a* which is adapted to be folded about perforated fold line 14 for closure of the return envelope when desired. Of course, the return envelope includes a preprinted address, as best illustrated in FIG. 2, so that it need simply be sealed and stamped for return mailing.

When the data bearing section of the two-way envelope or mailer is completely separated from the return envelope, the upper and lower adhesive sealed margins are removed along tear lines 42 and 43, and it may then be unfolded along center line 20 to appear as illustrated in FIG. 1. This data bearing portion itself may be further segmented along perforated transverse center line 20 and along perforated tear line 44 to produce three separate sections, one comprising the body panel 11, which may be retained for the records of the primary addressee, one consisting of the lower section of panel 12 carrying the window 16 which may simply be discarded, and one comprising the upper portion of panel 12 carrying appropriate identifying data which may be returned to the secondary addressee with or without notation by the primary addressee. For example, if the mailer unit is intended to constitute a statement of account for payment by the primary addressee, panel 11 will have details of the outstanding account for the records of the primary addressee, whereas the upper section of panel 12 may have an indication of the amount payable, particulars of the primary addressee's account number, and perhaps a space where the primary addressee may insert the amount of its payment so that this portion may be inserted into the return envelope together with a check in payment of the outstanding account, the return envelope then sealed, stamped and returned to the original sender.

It will be apparent from the foregoing that there is provided a two-way envelope which is produced from a single sheet of material utilizing only a minimum of conventional processing steps, and which, in an extremely simple manner, provides a complete return envelope as well as discreet data bearing panels which can be utilized to provide a record for the use of both the primary addressee and the original sender, or a secondary addressee. It will be obvious to one skilled in the art that modifications may be made to the arrangement of tear lines, arrangement of adhesive bearing portions, and indicia to be carried by both data bearing and return envelope panels without deparating from the scope of the invention. For example, while the preferred form of the invention is illustrated in the drawings, it is of course possible to reverse the location of the data bearing and return envelope panels with relatively minor modification to the layout illustrated in FIG. 1.

What is claimed is:

1. A two-way envelope unit suitable for use in continuous form formatting, comprising, a single rectangular sheet, with that single sheet having a transverse central line of weakness, separable line-hole bearing side margins parallel to said central line of weakness, and a top and bottom margin, a data receiving panel and a pair of return envelope panels for use when folded as an envelope, the return envelope panel comprising part of the single sheet and disposed between said central line of weakness and each of said side margins, each data receiving panel being adjoined to each return envelope panel along a line of separation parallel to said central line of weakness, sealing means disposed on one side of said sheet along the top margin of at least one of said data receiving panels and at least one of said return envelope panels, along the bottom margin of at least one of said data receiving panels and at least one of said return envelope panels, and along a side edge of at least one of said panels adjacent one of said side margins whereby, when the single sheet is folded about said central line of weakness, said data receiving panels overlie one another and said return envelope panels form an envelope by overlying one another and said lines of separation are offset to define an adhesive bearing return envelope flap, said top and bottom margins being free of sealing means at said return envelope flap.

2. A two-way envelope unit as defined in claim 1 wherein said data receiving panels are disposed adjacent said central line of weakness, and said return envelope panels are disposed adjacent said side margins.

3. A two-way envelope unit as defined in claim 2, wherein said sealing means is a heat activated adhesive applied to the top and bottom margin of one data receiving panel and one return envelope panel, and along one side of a return envelope panel adjacent one of said side margins.

4. A two-way envelope unit as defined in claim 3, wherein one of said data receiving panels is divided in two sections by a line of separation parallel to the upper and lower margins.

5. A two-way envelope unit as defined in claim 4, wherein a window is disposed in one of said sections of the data receiving panel.

6. A two-way envelope unit as defined in claim 5 wherein lines of separation extend across said data receiving panels adjacent and parallel to the upper and lower margins thereof, and spaced inwardly from said margins a distance corresponding to the width of said sealing means, whereby said sealing means may be removed from the remainder of said data receiving panels.

7. A two-way envelope unit as defined in claim 1 wherein said adhesive is a pressure sensitive adhesive covered by a release paper.

8. A two-way envelope unit as defined in claim 1 wherein one of said return envelope panels is provided with a pre-printed address on a side thereof remote from said sealing means.

9. A two-way envelope formed of a single rectangular sheet folded upon itself about a transverse central foldline and having a front and rear surface, comprising, overlying front and rear return envelope panels and overlying front and rear data bearing panels formed from folding the single sheet, front and rear transverse lines of separation parallel to said central transverse foldline and separating said return envelope panels from said data bearing panels, said transverse lines of separation being offset to define on one surface a return envelope flap adjoining one of said return envelop panels by a line of weakness, adhesive disposed on the inner surface of said return envelope flap, and sealing means securing the three free edges of said two-way envelope about said central foldline except those portions of the edges coincident with said return envelope flap.

10. A two-way envelope as defined in claim 9 wherein said data bearing panels are adjacent said central foldline and said return envelope panels are remote therefrom.

11. A two-way envelope as defined in claim 10, wherein one of said data bearing panels is bisected to form two sections by a line of separation perpendicular to said central transverse foldline.

12. A two-way envelope as defined in claim 11, wherein one of said sections of said one data bearing panel is provided with a window disposed in alignment with a primary address printed on the inside surface of said other data receiving panels.

13. A two-way envelope as defined in claim 9 wherein said data bearing panels are provided with aligned lines of separation extending perpendicular to said central foldline and spaced from the upper and lower edges of the envelope a distance corresponding to the width of said sealing means whereby said sealing means may be torn free from the remainder of said data bearing panels when said data bearing panels are separated from said return envelope panels along said front and rear transverse lines of separation.

14. An envelope as defined in claim 9 wherein one of said return envelope panels, on the exterior thereof, is provided with a pre-printed secondary address.

15. A two-way envelope as defined in claim 9 wherein said adhesive is a pressure sensitive adhesive covered with a release paper.

* * * * *